United States Patent [19]

Agee

[11] Patent Number: 4,852,930

[45] Date of Patent: Aug. 1, 1989

[54] UTILITY DECORATOR

[76] Inventor: Lois M. Agee, 2922 Gulf of Mexico Dr., Longboat Key, Fla. 34228

[21] Appl. No.: 878,053

[22] Filed: Jun. 24, 1986

[51] Int. Cl.[4] ..... A47F 7/00; A47G 29/00; B25H 3/04

[52] U.S. Cl. ..... 294/143; 206/373; 206/457; 211/70.6; 294/146; 428/542.2; 428/913.3; D3/105; D11/133

[58] Field of Search ..... 294/137, 141–144, 294/146, 159, 161–163, 172; 206/234, 349, 372–374, 457; 211/70.1, 70.6, 86–89, DIG. 1; 248/309.1, 37.3, 37.6, 309.2; 312/204, DIG. 33; 40/19.5, 152.1, 913; 223/106–109 A; D3/18, 20, 21, 105; D9/341, 347; D11/133; 428/542.2, 542.6, 913.3

[56] References Cited

U.S. PATENT DOCUMENTS

| | | | |
|---|---|---|---|
| D. 134,208 | 10/1942 | McCrary | D3/21 |
| D. 170,798 | 11/1953 | Dundon et al. | 211/70.6 X |
| 361,248 | 4/1887 | Winton | 211/DIG. 1 |
| 1,525,748 | 2/1925 | Klein | 223/108 X |
| 1,538,621 | 5/1925 | Chase | 211/70.6 X |
| 1,615,030 | 1/1927 | Nock | 206/457 X |
| 2,145,879 | 2/1939 | Jewett | 294/143 X |
| 2,234,739 | 3/1941 | Murrell | 223/106 |
| 2,495,866 | 1/1950 | Perry et al. | 211/70.6 X |
| 2,574,862 | 11/1951 | Duke | 223/107 X |
| 2,733,113 | 1/1956 | Humbargar | 211/70.6 X |
| 3,023,891 | 3/1962 | Sutter | 211/70.6 X |
| 3,170,612 | 2/1965 | Blumenschein | 294/143 |
| 3,363,775 | 1/1968 | Shaw | 211/70.6 |
| 3,930,702 | 1/1976 | Pichowicz | 206/457 X |
| 4,511,040 | 4/1985 | Tolentino | 211/70.6 X |

FOREIGN PATENT DOCUMENTS

| | | | |
|---|---|---|---|
| 716791 | 1/1942 | Fed. Rep. of Germany | 211/70.6 |
| 2703367 | 8/1978 | Fed. Rep. of Germany | 206/373 |
| 724407 | 4/1932 | France | 223/106 |
| 1562845 | 4/1969 | France | 211/70.6 |
| 2355619 | 2/1978 | France | 294/144 |
| 2520481 | 7/1983 | France | 223/108 |

OTHER PUBLICATIONS

Xerox Disclosure Journal, vol. 5, No. 1, Jan./Feb. 1980, "Vacuum-Formed Tool Pallet" by L. W. Shaffer.

The Star Magazine (Wash., D.C.), Feb. 14, 1960, p. 131, photograph.

Hardware Age Magazine, Mar. 8, 1951, p. 79, "Mother's Own Set of Tool", advertisement.

Good Housekeeping magazine, Feb. 1974, p. 70, "Organizer for Sewing Accessories", advertisement.

Avant Products advertisement, Sep. 1967, "Unique Ladyfingers Sewing Compact".

*Primary Examiner*—Johnny D. Cherry

[57] ABSTRACT

A portable, wall hanging tool holding device comprising an elongated foundation from which stud type tool supports protrude and in which openings are formed where accessories, such as nails, screws, tape rule, pencil, paper, etc. may be stored. Tools, etc. remove and replace easily. A novel handle placement upon the face of the foundation facilitates removal from hanging and transporting an entire load of tools. A unique wall mounting device further streamlines the use of this unusual tool holder, which also has horizontal position supports and will also stand as a rack. Finally, this tool holder is decorated to make it feasible to hang it in a kitchen, den, bedroom or the like. Paint, paper, fabric and artificial flowers with tools and hardware may be odd bedfellows, but they solve a long standing tool access and storage problem for occupants of apartments and other establishments where storage areas are lacking. The Utility Decorator, used in combination with decorator tools, (tools which are themselves decorated), forms a "set" by decor which expands the decorator function to the maximum.

8 Claims, 2 Drawing Sheets

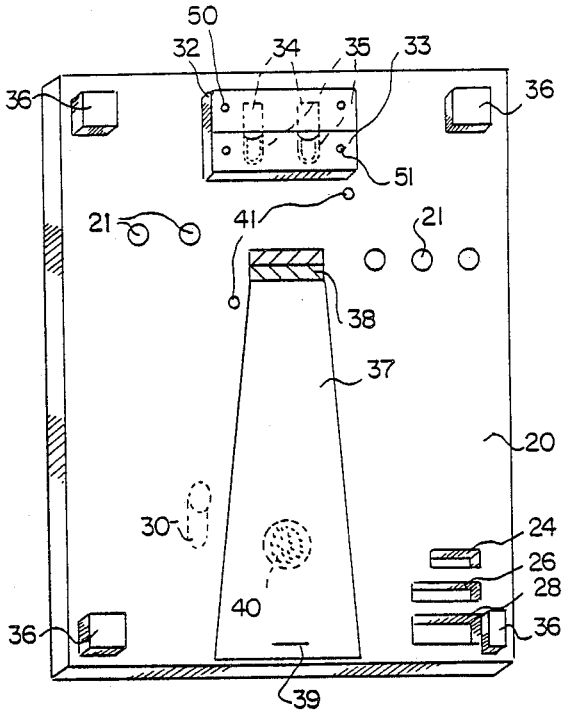
FIG. 1
FIG. 2
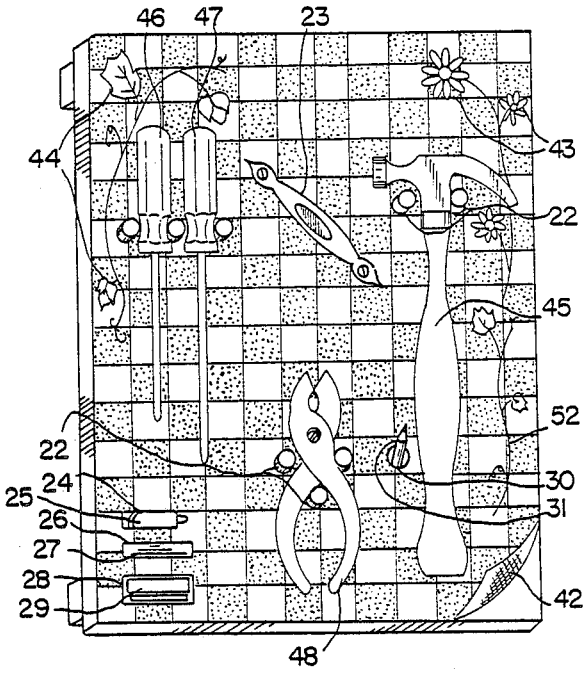

UTILITY DECORATOR

BACKGROUND OF THE INVENTION

This invention relates to hand tool holders and more specifically to a portable, decorator, hanging tool holder. In this application, where reference is made to a tool holder, let it be understood the inventor is referring to a hand tool holder, and let it be understood the type of hand tools referred to are of the species of construction and maintenance small hand tools such as hammers, pliers and screwdrivers and the like to differentiate from other hand tools such as power tools, cutlery, etc.

Hand tools are a necessity wherever people live and work. Some of the problems of storing, transporting and general access to these tools have been mitigated by devices provided by the prior art. However, these devices have failed to provide a tool storage holder with versatility. Heretofore, hanging tool holders have been complex, unwieldly, inartistic, inelegant and immovable. They are only appropriately hung in basements, garages or other working areas. Further, there is the awkwardness of dislodging the individual tools from the holder, often requiring the use of both hands, then the awkwardness of transporting them, and the necessary accessories, to the work location. Many trips must be made to the holder in order to utilize it. Where storage areas are not available, such as in apartments and small offices, etc., it is impossible to utilize any sort of hanging tool holder and, consequently, tools must be stuffed into already crowded closets and drawers.

The need for a tool holder which can be displayed in the living quarters of a home, and especially in apartments where storage space is lacking, inspired the present invention.

SUMMARY OF THE INVENTION

The present invention is concerned with eliminating the deficiencies of the prior art in order to make the access and use of hand tools as convenient as possible; and with overcoming the workshop, eyesore problem associated with the storing of these frequently used tools, and thereby making it feasible to display a fully loaded tool holder in the living quarters of a residence; in a den, bedroom, living room, upstairs and down.

This invention accomplishes these objects:

1. By providing an economical, light weight tool holder with a foundation which may be made of wood, metal, plastic, masonite; made by molding means and the like; of unlimited size and shape; it may be round, square, oblong, shaped like an apple, dog, boat.. any feasible shape whatsoever and any feasible size; the said foundation having a plurality of stationary tool holding members which may be made of wood, metal, plastic, rubber, ceramics, molding means, and the like; the holding members may be pegs, pins, knobs, contoured means shaped to fit the objects supported, molded means, cutouts, nails, screws, hooks, clips, snaps, collars, loops, studs and the like.

2. By providing a means for removably attaching said tool holder to a wall or other surface where it is to hang, said attaching means being made of wood, metal, plastic, rope or the like.

3. By providing a means for removing, transporting and replacing said tool holder; said means comprising a handle, knob or other graspable contrivance made of wood, metal, plastic, rubber, ceramics, fabric, rope, molded means and the like.

4. By providing a tool holder with means for supporting said tool holder when it is in use at a work location and operates in a horizontal position from a table top or the like; and by providing means for supporting said tool holder in a rack position; said means comprising legs, folding legs, telescoping legs, hob-nails, felt or other pads, feet, knobs, posts, props, braces and the like, which may be made of wood, metal, plastic, rubber, masonite, molding means, ceramics and the like.

5. By providing a tool holder which also stores a supply of hardware such as nails, screws, a measuring device, pencil and paper and other items which facilitate the use of tools and said holder, said tool holder comprising accommodation means such as a niche, slot, cubicle, chamber, recess, opening, prop, support, box, tube, case, vessel, basket, sheath, cannister, jar, bag, and the like.

6. By providing tool holders in a wide variety of color schemes and interior decorating themes to make them compatible with periods of furniture and individual tastes; tool holders which may be finished and trimmed with the likes of paint, paper, wall paper, contact paper, glitter, stain, fabric, plastics, carvings, burnings, antiqueing, metal, wood, ceramics, colorful molding means, artificial flowers and plants.

7. By providing decorator tools for use with said tool holders to form a "set" by decor, the tools themselves being decorated by means of paints, decals, dyes, carvings, stains, plastics, ceramics and the like.

8. By providing tool holders with or without tools, which are made ready to be finished as a decorate-it-yourself item so the user can decorate with the exact same paint or wall paper, etc. which decorates the room where the holder will be placed.

With this invention tools are always handy and the user can reach up single handedly and smoothly remove the entire set and, still grasping the handle, single handedly transport said holder to a work location. There, all items remove and replace easily.

These attractive tool holders serve to decorate, display, organize, store, transport and caddie hand tools. They smarten and embellish the home environment while saving space and time and generally make life a little easier. They can be inexpensively mass produced. The invention is a true novelty yet still compatible with standard use; obsolescence is nil; it knows no season, demand is constant, and it works!

Other and further objects of the present invention will be apparent from the following description and claims, and are illustrated in the accompanying drawings, which, by way of illustration, show a preferred embodiment of the present invention and the principles thereof, and what is now considered to be the best mode in which to apply these principles. Other and different embodiments of the invention employing the same or equivalent principles may be used and structural changes may be made as desired by those skilled in the art without departing from the invention.

BRIEF DESCRIPTION OF THE DRAWINGS

FIG. 1 is a perspective view of the back of the Decorator Tool Holder of this invention.

FIG. 2 is a perspective view of the front side of the tool holder of FIG. 1.

DETAILED DESCRIPTION OF THE PREFERRED EMBODIMENT

Figure 4:
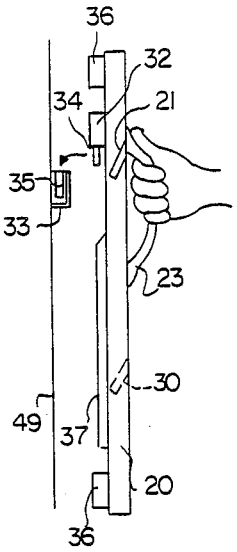
FIG. 4 is a side view of the tool holder of FIG. 1 and FIG. 2.

FIG. 1 shows the placement of four feet 36 which are made of wood and are secured to the back of the foundation 20 of the tool holder by glue, the prop 37, which is used to hold said tool holder upright in a rack position is secured to the foundation 20 by a metal hinge 38 and is held closed when not in use by two patches of Velcro 40, one attached to the under side of said prop, the other just opposite on the back of said foundation 20, said prop being constructed of masonite; an opening for a tape tule 24, opening for a pad of paper 26, and an opening for a container of nails and screws 28 are at the lower right corner of said FIG. 1 and are properly sized to receive and hold these items securely when said items are inserted to the length created by the attachment of said feet 36; a sheath 30 is formed substantially vertically within said foundation 20 to house a pencil and, since the sheath 30 in the present embodiment is accessible from the front side, is shown in broken line outline. A stapled-in fabric tab 39 opens prop 37.

At the top and center of said foundation is positioned the wall attachment top half 32 and bottom half 33, shown in the engaged position with prongs 34, which protrude from the said top half 32 inserted into the apertures 35 which are formed in said bottom half 33, said prongs 34 and said apertures 35 being sized for easy insertion and removal while still providing a stable position when said tool holder is mounted; the said attachment top half 32 being permanently attached to the said foundation 20 by screws 50 on each side, said bottom half 33 attaches to a wall or other surface by way of screw holes 51 formed within said bottom half 33.

FIG. 2 shows the front of said tool holder with all times in place; the handle 23 is wrought iron and is attached by screws 41; wooden studs 22, protruding from the face of the foundation 20, secured by size and glue, support a Phillips screwdriver 46, a regular screwdriver 47, a hammer 45 and pliers 48. A tape rule 25 is inserted into opening 24; a pad of paper 27 is inserted into opening 26, a box of screws and nails 29 is inserted into opening 28; a pencil 31 is inserted into sheath 30. The foundation 20 is covered with a glued-on, coarse, black and white checked, cotton fabric 42 which wraps around the sides and is secured to the back of said foundation by glue and staples (see FIG. 5). Artificial flowers 43 and leaves 44 are secured in a decorative position to the face of said foundation 20 with staples 52. All tools, 45, 46, 47, 48 are finished with a bright schoolbus yellow paint with a black trim. The same paint and trim finish the tape rule 25 and the box for nails 29. The pad of paper is white, the feet 36 painted schoolbus yellow; the flowers 43 are white with yellow centers and the leaves 44, of course, are green, completing the decoration of the preferred embodiment of the decorator tool holder of this invention.

Figure 3:
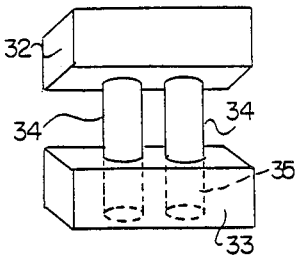
FIG. 3 is an exploded view of the preferred embodiment of the wall attaching means.

FIG. 3 illustrates the principle and operation of the wall attaching means of the preferred embodiment, the proper half 32, comprising prongs 34, being attached to the back of the foundation 20, and the bottom half 33 comprising apertures 35, for receiving said prongs 34, said bottom half 33 being attached to a wall or other surface.

FIG. 4 illustrates how the handle 23 is used to engage and disengage the said tool holder foundation 20 at the hanging location. By grasping said handle 23 and lifting up and away the top half 32 of the attaching device is disengaged from the bottom half 33 which is attached to a wall 49, said handle 23 is then used to transport said tool holder.

Figure 5:
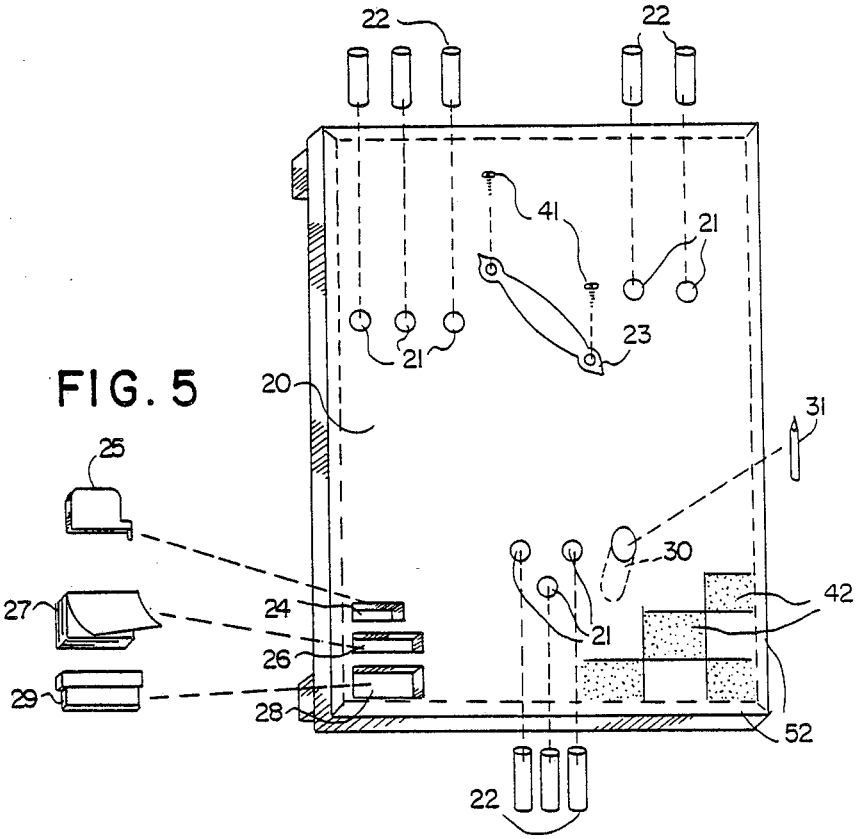
FIG. 5 is a perspective view of the front side of the tool holder of FIGS. 1 through 5 showing assemblage of parts.

FIG. 5 illustrates, from the front, the construction of the tool holder; an oblong planar foundation 20 of wood wherein openings 21 are formed to receive studs 22, which fit snugly and are further secured with glue; openings 24, 26, 28 and 30 are formed therein to receive and house a tape rule 25, a pad of paper 27, a box of nails and screws 29 and a pencil 31. The handle 23 is made of wrought iron and is positioned at an angle to enhance the decor, and is secured by screws 41.

The fabric 42, which covers the face of said foundation 20 is wrapped around the sides of said foundation 20 and secured by glue and staples 52 around the edges on the back side of said foundation 20, as shown in broken line around edges.

While the above description contains many specificities, these should not be construed as limitations on the scope of the invention, but rather as an exemplification of one preferred embodiment thereof. Many other variations are possible, as pointed out under the Summary of the Invention. Accordingly, the scope of the invention should be determined not by the embodiment illustrated, but by the appended claims and their legal equivalents.

I claim:

1. A decorating device of use in a residence room of choice which utilizes at least one hammer and at least one set of pliers as an integral part thereof, said decorating device to function as a decorator and also as a caddy and storage holder, said decorating device comprising a rigid foundation and decoration means therefor, said decoration means being selected from the group consisting of coverings, coatings, moldings, carvings, attachments, impregnations, burnings and antiqueing, said foundation comprising a plurality of support means for said hammer and said pliers, said support means comprising a decorative aspect relative to said foundation whereby said support means functions decoratively as part of said decorating device, said foundation comprising means for transporting said decorating device and whereby said decorating device functions as a working caddy, said means for transporting said decorating device comprising handle means positioned upon said foundation whereby said decorating device may be removed from a vertical surface, transported and replaced single handedly, said handle means comprising a decorative aspect relative to said foundation whereby said handle means functions decoratively as part of said decorating device.

2. The decorating device of claim 1 comprising said hammer and said pliers, said hammer and said pliers comprising decoration means relative to said foundation whereby said hammer and said pliers function as an integral part of said decorating device, thereby creating an ensemble by decor.

3. The decorating device of claim 2, wherein said foundation, said hammer and said pliers comprise exterior surfaces which have been prepared to receive selected decoration means with regard to motif of choice whereby an ensemble may be created decoratively involving said foundation and said hammer and said pliers to conform with any individual taste, said decorating device to be decoratively finished by intended user if desired.

4. The decorating device of claim 2, said foundation comprising at least one aperture for housing accessories.

5. The decorating device of claim 4, said support means comprising fixed studs protruding from the face of said foundation.

6. The decorating device of claim 5, said foundation comprising a substantially planar structure.

7. A decorating device for the interior use of a residence which utilizes as an integral part thereof, hammers, screwdrivers and pliers and other implements of construction and maintenance, said decorating device comprising a foundation comprising a substantially planar structure, said foundation comprising a plurality of fixed studs protruding from the front thereof for the purpose of supporting said hammers, screwdrivers and plier and said other implements, said foundation comprising at least one means for housing accessories, said foundation comprising decorating means whereby said decorating device functions as a decorator, said foundation comprising a substantially centrally positioned frontally fixed handle to facilitate single handed handling of said decorating device when placing upon or removing from a vertical surface where said decorating device foundation as a decorator and also to single handedly transport said decorating device to a work location where it also functions as a working tool holder, said foundation comprising means therewith for supporting and spacing said decorating device in a position sufficiently spaced or raised from an adjacent surface to avoid abrasive damage to a wall or furniture from the underside of said foundation.

8. A decorating device for the interior use of a residence which utilizes as an integral part thereof, hammers, screwdrivers and pliers and other implements of construction and maintenance, said decorating device comprising a foundation comprising a substantially planar structure, said foundation comprising a plurality of fixed studs protruding from the front thereof for the purpose of supporting said hammers, screwdrivers and pliers and said other implements, said foundation comprising at least one aperture for housing accessories, said foundation comprising a substantially centrally positioned frontally fixed handle to facilitate single handed handling of said decorating device when placing upon or removing from a vertical surface where said decorating device functions as a decorator and also to single handedly transport said decorating device to a work location where it also functions as a working tool holder, said foundation comprising means therewith for supporting and spacing said decorating device in a position sufficiently spaced or raised from an adjacent surface to avoid abrasive damage to a wall or furniture from the underside of said foundation, said foundation comprising decorating means whereby said decorating device functions as a decorator.

* * * * *